United States Patent [19]

Comploi et al.

[11] 4,434,728

[45] Mar. 6, 1984

[54] ELECTROMAGNETIC PATTERN SELECTOR FOR AN EMBROIDERY MACHINE

[75] Inventors: Georg Comploi, Bludenz, Austria; Roland Heimgartner, Arbon, Switzerland; Artur Loacker, Goetzis, Austria; Kurt Huber, Arbon; Hans Wallimann, Goldach, both of Switzerland

[73] Assignee: Aktiengesellschaft Adolf Saurer, Arbon, Switzerland

[21] Appl. No.: 345,080

[22] Filed: Feb. 2, 1982

[30] Foreign Application Priority Data

Feb. 4, 1981 [CH] Switzerland ..... 731/81

[51] Int. Cl.[3] ..... D05C 11/06

[52] U.S. Cl. ..... 112/84; 112/221

[58] Field of Search ..... 66/232; 112/79 A, 84, 112/78, 221, 98

[56] References Cited

U.S. PATENT DOCUMENTS 3,608,336 9/1971 Phillips ..... 66/232

FOREIGN PATENT DOCUMENTS 718816 3/1942 Fed. Rep. of Germany ..... 66/232
2518712 11/1976 Fed. Rep. of Germany ..... 66/232
3023160 1/1981 Fed. Rep. of Germany ..... 112/78
2938903 4/1981 Fed. Rep. of Germany ..... 112/78

*Primary Examiner*—Werner H. Schroeder
*Assistant Examiner*—Andrew M. Falik
*Attorney, Agent, or Firm*—Werner W. Kleeman

[57] ABSTRACT

A positioning device for a mechanical switching lever arrangement in an embroidery machine comprises an electromagnetic device which serves for displacing a pawl lever between a first end position and an intermediate position. The pawl lever serves for actuating a switching lever arrangement. The positioning device further comprises a mechanical amplifier device for displacing the pawl lever between the aforementioned intermediate position and a second end position. At its free end region the pawl lever carries a permanent magnet which continuously adheres to the electromagnet when the same is deenergized. The mechanical amplifier device, which cooperates with the pawl lever, comprises an externally actuatable switching lever arrangement. By pivoting this switching lever arrangement the pawl lever can be displaced from its intermediate position to the second end position and vice versa. In this way there can be initiated, at first, a displacement operation, by means of a relatively small arrangement of magnets, whereupon the actual positioning or adjustment work is carried out exclusively by means of the mechanical amplifier.

9 Claims, 1 Drawing Figure

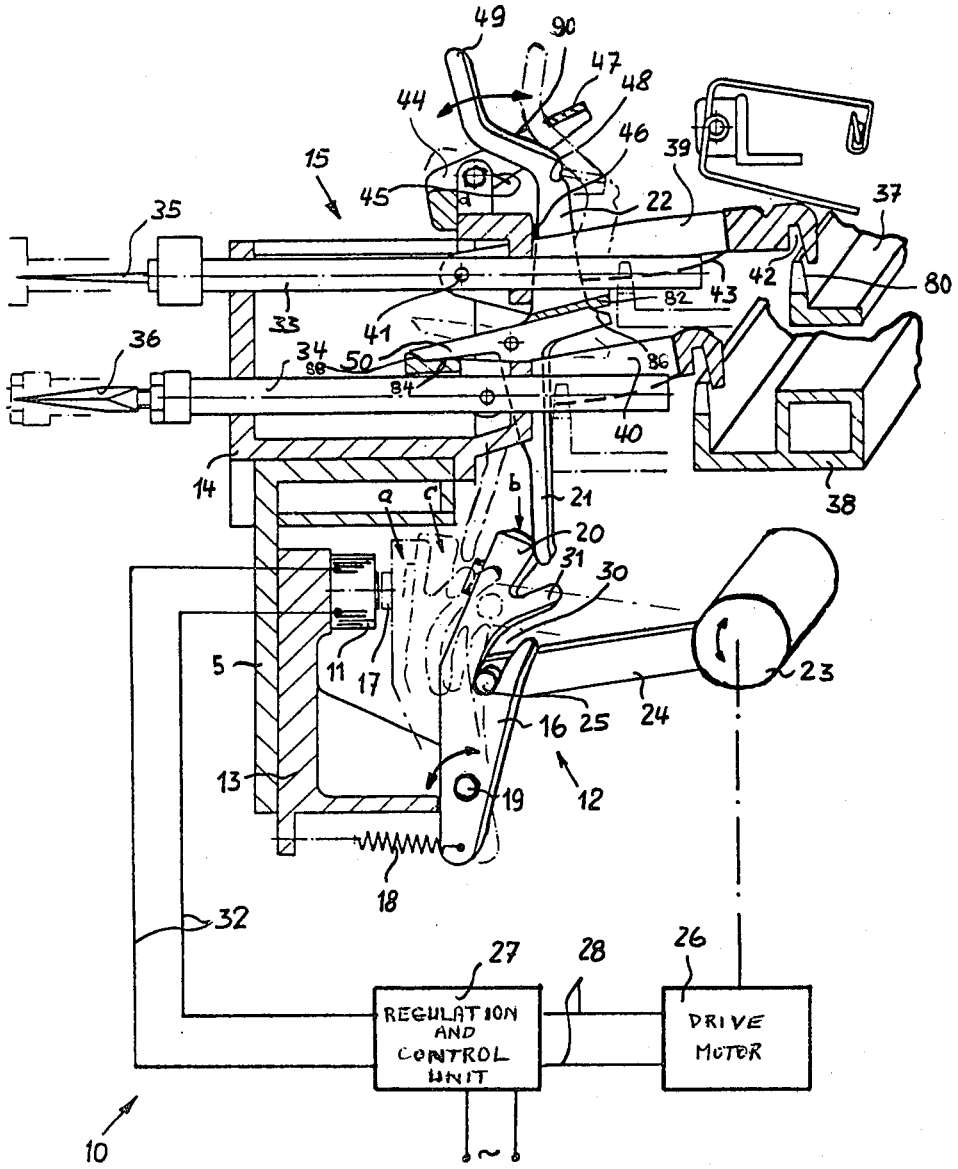
REGULATION AND CONTROL UNIT
DRIVE MOTOR

ELECTROMAGNETIC PATTERN SELECTOR FOR AN EMBROIDERY MACHINE

CROSS-REFERENCE TO RELATED APPLICATION

This application is related to our commonly assigned copending U.S. application Ser. No. 06/345,091, filed Feb. 2, 1982, entitled "Embroidery Machine Pattern Mechanism".

BACKGROUND OF THE INVENTION

The present invention relates to a new and improved construction of positioning device for a mechanical switching lever arrangement, especially at an embroidery machine, and to a method of using such positioning device.

In many technological fields of application it is necessary to automatically displace switching lever arrangements for instance according to a selectable program. For this purpose, it is beneficial to use electromagnets as the positioning or adjustment means. However, if the switching lever arrangements to be displaced are voluminous and/or if the displacement paths are relatively long, then there are required comparatively large powerful electromagnets for carrying out the necessary positioning or adjustment work.

For instance, at embroidery machines it is necessary, among other things, to selectively bring the embroidering implements arranged at the embroidery locations into an effectual, i.e. working position, and into an ineffectual, i.e. rest position. For this purpose, the positioning or adjustment means are actuated, for instance, by electromagnets. At an embroidery machine, where 1000 or more such embroidery locations to be adjusted or displaced may be present, the power consumption at the positioning electromagnets is of considerable importance. A further drawback is the great structural volume of such arrangements.

SUMMARY OF THE INVENTION

Therefore, it is a primary object of the present invention to provide a new and improved construction of positioning device of the initially mentioned type, which is not associated with the aforementioned drawbacks and limitations of the prior art constructions.

Another important object of the present invention aims at providing a new and improved construction of positioning device of the initially mentioned type which, in relation to prior art constructions, requires a considerably smaller electromagnet, both with respect to the power requirements and the spatial requirements thereof.

Still another important object of the present invention, and in keeping with the immediately preceding object, is to provide a new and improved construction of positioning device of the initially mentioned type, which, while using smaller electromagnets, is nonetheless capable of performing any required positioning or adjustment work.

According to the invention, these and still other objects which will become more readily apparent as the description proceeds, are attained in that the inventive positioning device is provided with an electromagnetic device for displacing a pawl or latching lever between a first end position and an intermediate position, and which pawl or latching lever serves for actuating the switching lever arrangement. Such positioning device according to the invention is further provided with a mechanical amplifier device for displacing the pawl or latching lever between the aforementioned intermediate position and a second end position.

An advantageous construction of the positioning device according to the invention contemplates arranging at the free end or free end region of the pawl lever a permanent magnet which constantly adheres to or remains in contact with the electromagnetic device when the same is deenergized. Furthermore, there is provided for the mechanical amplifier device, which cooperates with the pawl or latching lever, an externally actuatable pivot lever arrangement. By pivoting or rocking this pivot lever arrangement the pawl or latching lever can be moved from its intermediate position to the second end position and vice versa. Moreover, in its first end position the pawl or latching lever is exposed to the action of a positioning or displacement path-adjustment spring.

According to a further advantageous cnstruction of the positioning device according to the invention the pawl or latching lever is provided with an impact or contact surface, by means of which the pawl lever, when in its intermediate position, bears against the pivot lever arrangement of the mechanical amplifier device. Furthermore, the pawl or latching lever is provided with a substantially curve-shaped adjustment slot with which engages a switching rod of the pivot lever arrangement during the displacement of the pawl or latching lever between its intermediate position and its second end position.

As already alluded to above, a further aspect of the present invention relates to the use of the inventive positioning device at an embroidery machine. Such embroidery machine is provided with embroidering implement rods which are mounted and displaceably guided in at least two rows at the embroidery machine. Each of these embroidering implement rods can be coupled with or decoupled from a related one of two operatively associated oscillating drive rails or tracks in accordance with a predetermined program. Significantly, the embroidering implement rods which are related to the same embroidery location and which are, for instance, arranged in superimposed relationship, can be simultaneously coupled to or decoupled from the operatively associated drive rail or track by means of a common switching lever. This common switching lever can be actuated either manually, or automatically by means of the pawl or latching lever.

In this regard, it is advantageous if the common switching lever cannot be actuated by the pawl or latching lever whenever the common switching lever is located in a manually induced arrested end position. Such arrested end position causes the embroidering implement rods to be decoupled from the corresponding drive rails or tracks.

BRIEF DESCRIPTION OF THE DRAWING

The invention will be better understood and objects other than those set forth above will become apparent when consideration is given to the following detailed description thereof. Such description makes reference to the annexed single FIGURE of the drawing which shows in schematic side view a positioning device according to the invention and in cooperating relationship with an embroidery location of an embroidery machine.

DETAILED DESCRIPTION OF THE PREFERRED EMBODIMENTS

Describing now the drawings, the positioning or adjustment device according to the invention is generally indicated by reference numeral 10 and comprises an electro-magnetic device and a so-called mechanical amplifier 12. The electromagnetic device comprises an electromagnetic 11 which is relatively small, both with respect to its power consumption and its constructional size. This electromagnet 11 is secured to a support or holder 13. This support or holder 13 is fixed to a carrier 5 of an embroidery location 15 of an embroidery machine to be discussed more fully hereinafter. The electro-magnet 11 cooperates with a pawl or latching lever 16 which carries at its free end or free end region a permanent magnet 17. This permanent magnet 17 continually adheres to the electromagnet 11 when the same is deenergized, and specifically against the action of a positioning or displacement path-adjustment spring 18. This displacement path-adjustment spring 18 engages at the other end of the pawl or latching lever 16 which is mounted at the support 13 so as to be pivotable about a pivot pin or plug 19. At its upper free end, according to the illustration, the pawl or latching lever 16 furthermore carries an actuation nose 20 which has a suitable configuration and serves for actuating a switching lever arrangement to be displaced, i.e. here the embroidery location 15 in the embodiment under discussion. The actuation nose 20 forms an entrainment connection to a positioning arm 21 of a switching lever 22 of the embroidery location 15, as will be described hereinafter in greater detail.

The mechanical amplifier 12 which cooperates with the pawl or latching lever 16 comprises an advantageously motor-driven switching shaft 23. By means of a radially protruding lever arm 24 this switching shaft 23 carries a switching pin or a switching rod 25 or equivalent structure.

The arrangement can be carried out such that the switching shaft 23 and switching rod 25 extend over a number of positioning devices 10 which are adjacently arranged in rows and simultaneously actuated by means of such switching shaft 23 and switching rod 25. This is the case, for instance, with embroidery machines where the 500 and more embroidery locations 15 per row require an equal number of adjacently arranged positioning devices 10, the pawl or latching levers 16 of which are all actuated by the common switching rod 25. The switching shaft 23 is driven by a drive motor 26 by means of a not particularly illustrated cam. The drive motor 26 receives its positioning or adjustment pulses through any suitable regulation and control unit 27 via control lines 28.

Upon rotating the switching shaft 23 and together therewith the lever arm 24 in the counterclockwise sense the switching rod 25 is downwardly pivoted. Hence, this switching rod 25 thus enters a substantially curve-shaped positioning or adjustment slot 30 provided at the pawl or latching lever 16 and pivots the same in the clockwise sense about pivot pin or plug 19, if prior thereto the related pawl or latching lever 16 has been brought into the effective or operative region of the switching rod 25. The position c indicated in dot-dash or phantom lines constitutes an intermediate position, where an impact or stop nose 31 provided at the pawl or latching lever 16 temporarily impacts against the switching rod 25.

As previously mentioned, the permanent magnet 17 provided at the pawl or latching lever 16 adheres to the electromagnet 11 for as long as the same is without current. During this period of time, the pawl or latching lever 16 equally remains fixed against the action of its displacement path-adjustment spring 18 in its one end position a, which also has been indicated in the drawing by phantom or dot-dash lines. In this position the switching rod 25 is out of engagement with the positioning or adjustment slot 30 at the pawl or latching lever 16 and the actuation nose 20 at this pawl or latching lever 16 is spaced a predetermined distance from the actuatable positioning arm 21 of the switching lever 22. This aforementioned distance between the actuation nose 20, in the end position a, and the switching lever 22 to be actuated corresponds at least to a first displacement path through which the pawl or latching lever 16 must pass when moving from its rest position a into the aforementioned intermediate position c, so that it comes to impact against the switching rod 25 of the mechanical amplifier 12.

The displacement of the pawl or latching lever 16 from its first end position a into the aforementioned intermediate position c is performed in that the electromagnet 11 is activated by a current pulse, which is delivered by the regulation and control unit 27 via the lines or conductors 32. Consequently, the permanent magnet 17 at the pawl lever 16 is repelled and the pawl or latching lever 16 is pivoted into tha aforementioned intermediate position c. For this purpose it is only necessary that there is built-up at the electromagnet 11 a magnetic field which is sufficient for attenuating the permanent magnetic field to an extent such that the spring 18 can pivot the pawl lever 16 away from the armature of the electromagnet 11. This can be accomplished even by very small electromagnets which only require minimal energy.

Only when the pawl or latching lever 16 has arrived at its intermediate position c is it further pivoted or rocked by means of the mechanical amplifier 12 from this intermediate position c into the full line depicted end position b. At this point there is thus performed the necessary adjustment or positioning work at the switching lever 22 and there is actuated the corresponding switching lever arrangement, here one or a number of embroidery locations 15.

As will be further recognized by referring to the drawing, a return or resetting movement is accomplished such that initially the switching shaft 23 is rotated in the clockwise direction by means of the drive motor 26 and the drive cam which has not been particularly illustrated in the drawing. Thus, the pawl or latching lever 16 is pushed back in the counterclockwise direction into its intermediate position c under the action of the switching rod 25 which moves upwards according to the illustration. As soon as the pawl or latching lever 16 is almost totally disengaged from the switching rod 25 it is guided back towards the electromagnet 11 through the movement of the switching rod 25 against the nose or impact surface 31 unitl, under the effect of the attractive force of its permanent magnet 17, it arrives at its rest or other end position a, wherein the pawl lever 16 adheres to or contacts the armature of the no longer energized electromagnet 11.

This described positioning device according to the invention is extremely easy to realize and is capable of rapidly and reliably performing appreciable position or adjustment work, which makes it applicable for many fields of technology.

As previously mentioned, the positioning device according to the invention is especially suitable for simultaneously actuating the embroidery locations at an embroidery machine.

In the drawing there has been schematically illustrated such embroidery location 15 which may comprise for instance two superimposed embroidering implement rods or bars 33 and 34. These embroidering implement rods or bars 33 and 34 carry different embroidering implements, for instance, the rod or bar 33 carries a needle 35 and the rod or bar 34 a borer 36 or equivalent structure. The embroidering implement rods or bars 33 and 34 are displaceably guided in the not particularly referenced lateral or side walls of the bearing housing 14 and can be displaced to-and-fro in their lengthwise axis in a manner to be explained hereinafter in greater detail. The actuation of the needle rod or bar 33 is performed by means of a drive rail 37 for the needles 35 of the embroidery machine and the actuation of the rod or bar 34 is performed by means of a drive rail 38 for the borers 36 of the embroidery machine. The drive rails 37 and 38 each extend over the entire width of the embroidery machine and can be displaced in transverse direction so as to perform an oscillating to-and-fro motion in a conventional and therefore here not further described manner. The elements which cause the needle rods or bars 33 to be decoupled from or coupled to the drive rail 37 and the borer rods or bars 34 to be decoupled from or coupled to the drive rail 38 encompass a needle bar pawl or latching member 39 or a borer bar pawl or latching member 40, respectively. With one of their ends these pawls or latching members 39 and 40 are hinged to the related rod or bar 33 and 34, respectively, by means of a pivot pin or plug 41. At each of their free end the pawls 39 and 40 are provided with a downwardly open groove 42 for engaging over a related nose 80 provided at the respective drive rails 37 and 38. By means of springs 43 or equivalent structure the pawls or latching members 39 and 40 are pre-biased at their respective bars or rods 33 and 34 in the clockwise direction, and thus, are urged in the direction of their coupling or engagement position. The bars or rods 33 and 34 can be decoupled or disengaged from their drive rails 37 and 38, respectively, against the action of the related spring 43. For this purpose, the pawls or latching members 39 and 40 are provided at their lower side and at their upper side, respectively, with an inclined or obliquely extending control surface 82 and 84, respectively, which cooperate with a related control surface 86 and 88, respectively, provided at a transverse web 50 of the switching lever 22.

For manually pivoting the switching lever 22 out of the phantom line indicated work or active position of the relevant embroidery location into the rest or inactive position shown in solid lines there is here employed a manual switching rocker or manipulator element 44 which is provided with a locking or latching nose 47 and which is pivotally mounted at the bearing housing 14. This manual switching rocker is pre-biased in the counterclockwise direction by means of a spring 45. In contrast thereto, the switching lever 22 is pre-biased in the clockwise direction by means of a spring 46 or the like, wherein the locking or latching nose 47 provided at the manual switching rocker 44 serves as a stop for the switching lever 22. For manually decoupling or switching-out the switching lever 22 the switching rocker 44 must be pressed downwards, whereby the locking nose 47 pushes away the switching lever 22, in the counterclockwise direction, over an inclined control surface 90 until the locking nose 47 can jump into a latching device or catch groove 48 provided at the switching lever 22.

Thus, the rest or inactive position is attained. It is to be understood that the positioning arm 21, which is operatively connected or associated with the positioning device 10 according to the invention, equally has moved from the phantom line indicated operational position into the so-called rest or ineffectual position.

In order to manually bring back the corresponding embroidery location to the work position it is sufficient to slightly touch the manual positioning arm 49 of the switching lever 22 and to slightly press it towards the left side according to the drawing. Hence, the locking nose 47 is disengaged from or cammed out of the latching groove or device 48 and the switching rocker 44 can jump back under the action of its pre-biasing spring. With the subsequent disengagement of the switching lever 22 the same jumps back under the action of its return spring 46. As a consequence thereof, the pawls or latching members 39 and 40 are disengaged from the transverse web 50 of the switching lever 22 and recoupled to the respective drive rail 37 and 38 under the action of their pre-biasing spring 43.

As previously mentioned, the automatic actuation of the switching lever 22 is performed by means of the automatic positioning or adjustment device 10 by means of the positioning arm 21. However, this is not the case when the switching lever is located in the arrested rest position, which has been induced manually in the aforedescribed manner and which rest or inactive position causes the embroidering implement rods or bars 33 and 34 to be decoupled from the corresponding drive rails 37 and 38, as will be easily recognized by referring to the illustration.

In the embodiment of the invention under discussion the arrangement is chosen such that the positional adjustment or displacement of the pawl or latching lever 16 from the intermediate position c into the work position b is performed idly and without effect upon the switching lever 22 if the same is already located in the rest or inactive position. This rest position has been manually initiated in the aforedescribed manner and positionally arrested by virtue of the engagement of the locking nose 47 provided at the manual switching rocker 44 with the latching groove or device 48 provided at the switching lever 22.

Furthermore, the construction of the positioning or adjustment device 10 is undertaken such that the switching rod 25 can be moved past those pawl levers 16 which are located in their rest position a.

These measures enable switching any conceivable combination of embroidering (working) and non-embroidering (resting) embroidering implements, so that there can be selected any conceivable repeat.

In order to set a new repeat, all relevant pawl levers 16 are initially moved from the work position b into the intermediate position c by upwardly pivoting the switching rod 25. Thereupon, the pawl levers 16 pass through the remainder of the displacement path into their rest position, partially guided and partially under the effect of the magnetic field prevailing between the permanent magnet 17 and the electromagnet 11. Consequently, all embroidering implements are located in their embroidering work or effectual position, unless they have been arrested in their non-embroidering position through a manual switching-out operation.

For the new repeat there are now activated or energized by means of the regulation and control unit 27 all those electromagnets 11 which are arranged at embroidery locations which are required to be non-embroidering for this new repeat. In the manner described further above, the corresponding embroidering implements are then simultaneously placed into their ineffectual position by means of the mechanical amplifier device 12 and by the action of the switching lever 22.

At this point it again should be expressly stated that the aforedescribed positioning device according to the invention has been explained solely by way of example and not limitation in connection with an embroidering location of an embroidery machine. The field of application of the inventive positioning device thus should not be subject to any limitations by virtue of this exemplary field of application. The aforementioned example of possible utility of the inventive positioning device at an embroidery machine only is intended to illustrate that the positioning device according to the invention is capable of performing appreciable positioning or adjustment work, and specifically by means of the mechanical amplifier device, while requiring the use of only very small positioning magnets.

While there are shown and described present preferred embodiments of the invention, it is to be distinctly understood that the invention is not limited thereto but may be embodied and practiced within the scope of the following claims.

Accordingly, what we claim is:

1. A positioning device for a mechanical switching lever arrangement, especially for an embroidery machine, comprising:

a mechanical switching lever arrangement;

a pawl lever selectively movable stepwise between a first end position, an intermediate position and a second end position;

said pawl lever serving for actuating said switching lever arrangement;

electromagnetic means for liberating said pawl lever in order to move between said first end position and said intermediate position; and mechanical amplifier means for displacing said pawl lever between said intermediate position and said second end position.

2. The positioning device as defined in claim 1, further including:

a displacement path-adjustment spring: and said pawl lever being exposed to the action of said displacement path-adjustment spring when located in said first end position.

3. A positioning device for a mechanical switching lever arrangement, especially for an embroidery machine, comprising:

a mechanical switching lever arrangement;

a pawl lever selectively movable between a first end position, an intermediate position and a second end position;

said pawl lever serving for actuating said switching lever arrangement;

electromagnetic means for liberating said pawl lever in order to move between said first end position and said intermediate position;

mechanical amplifier means for displacing said pawl lever between said intermediate position and said second end position;

said pawl lever having a free end region;

a permanent magnet arranged at the free end region of said pawl lever; and said permanent magnet continuously adhering to said electromagnetic means when the latter is deenergized.

4. A positioning device for a mechanical switching lever arrangement, especially for an embroidery machine, comprising:

a mechanical switching lever arrangement;

a pawl lever selectively movable between a first end position, an intermediate position and a second end position;

said pawl lever serving for actuating said switching lever arrangement;

electromagnetic means for liberating said pawl lever in order to move between said first end position and said intermediate position;

mechanical amplifier means for displacing said pawl lever between said intermediate position and said second end position;

said mechanical amplifier means comprising an externally actuatable pivot lever arrangement; and said pawl lever being displaceable from said intermediate position to said second end position and vice versa by means of said externally actuatable pivot lever arrangement.

5. The positioning device as defined in claim 4, wherein:

said pawl lever possesses means defining an impact surface; and said pawl lever, when located in said intermediate position, bearing by means of said impact surface against said pivot lever arrangement.

6. A positioning device for a mechanical switching lever arrangement, especially for an embroidery machine, comprising:

a mechanical switching lever arrangement;

a pawl lever selectively movable between a first end position, an intermediate position and a second end position;

said pawl lever serving for actuating said switching lever arrangement;

electromagnetic means for liberating said pawl lever in order to move between said first end position and said intermediate position;

mechanical amplifier means for displacing said pawl lever between said intermediate position and said second end position;

a substantially curved adjustment slot provided at said pawl lever;

said pivot lever arrangement containing a switching rod; and said switching rod engaging with said adjustment slot during the displacement of said pawl lever between said intermediate position and said second end position.

7. A method of using a positioning device for a mechanical switching lever arrangement, at an embroidery machine which has embroidery implement rods mounted and displaceably guided in at least two rows at the embroidery machine, each of the embroidery implement rods being connectable to a related operatively associated oscillating drive rail so as to be selectively coupled thereto or decoupled therefrom, the improvement which comprises the steps of:

providing a common switching lever for selectively coupling and decoupling the superimposed embroidering implement rods correlated to the same embroidery location to the related operatively associated oscillating drive rail; and actuating said common switching lever by hand or automatically by means of a pawl lever.

8. The method as defined in claim 7, further including the steps of:

failing to actuate said common switching lever by means of said pawl lever if the common switching lever is located in a manually initiated arrested end position which causes the embroidery implement rods to be decoupled from the related drive rails.

9. A positioning device for a mechanical switching lever arrangement, especially for an embroidery machine, comprising:

a mechanical switching lever arrangement;

a pawl lever selectively movable between a first end position, an intermediate position and a second end position;

said pawl lever serving for actuating said switching lever arrangement;

electromagnetic means for liberating said pawl lever in order to move between said first end position and said intermediate position;

mechanical amplifier means for displacing said pawl lever between said intermediate position and said second end position;

said pawl lever having a free end region;

a permanent magnet arranged at the free end region of said pawl lever;

said permanent magnet continuously adhering to said electromagnetic means when the latter is deenergized;

said mechanical amplifier means comprising an externally actuatable pivot lever arrangement; and said pawl lever being displaceable from said intermediate position to said second end position and vice versa by means of said externally actuatable pivot lever arrangement.

* * * * *